US009406236B1

(12) United States Patent
Saccone et al.

(10) Patent No.: US 9,406,236 B1
(45) Date of Patent: Aug. 2, 2016

(54) MULTI-USER DISPARATE SYSTEM COMMUNICATIONS MANAGER

(71) Applicant: The Boeing Company, Chicago, IL (US)

(72) Inventors: Gregory T. Saccone, Kirkland, WA (US); Louis J. Bailey, Covington, WA (US); Ryan D. Hale, Kent, WA (US)

(73) Assignee: The Boeing Company, Chicago, IL (US)

( * ) Notice: Subject to any disclaimer, the term of this patent is extended or adjusted under 35 U.S.C. 154(b) by 446 days.

(21) Appl. No.: 13/911,398

(22) Filed: Jun. 6, 2013

(51) Int. Cl.
*G08G 5/00* (2006.01)

(52) U.S. Cl.
CPC ..... *G08G 5/0021* (2013.01); *G08G 5/0013* (2013.01); *G08G 5/0052* (2013.01)

(58) Field of Classification Search
CPC ... G05D 1/0005; G05B 13/02; G08G 5/0021; G08G 5/0013; G08G 5/0052
See application file for complete search history.

(56) References Cited

U.S. PATENT DOCUMENTS 6,014,729 A * 1/2000 Lannan ..... G06F 13/1605 710/200
6,080,202 A * 6/2000 Strickland ..... H04M 3/4217 370/259
6,408,336 B1 * 6/2002 Schneider ..... H04L 63/0218 709/229
6,522,958 B1 * 2/2003 Dwyer ..... G01C 23/00 340/995.1
6,538,581 B2 3/2003 Cowle
7,196,621 B2 3/2007 Kochis
7,349,773 B2 3/2008 Berard
7,433,779 B2 10/2008 Deker et al.
7,647,140 B2 1/2010 Demortier et al.
7,797,102 B2 9/2010 Fortier
8,010,288 B2 8/2011 Bouchet et al.
8,200,377 B2 6/2012 Marty et al.
8,200,514 B1 * 6/2012 Crean ..... G06Q 10/02 705/5
8,782,738 B2 * 7/2014 Lynch ..... 726/2
8,880,243 B1 * 11/2014 Duvall ..... G01C 23/005 701/120
8,989,561 B1 * 3/2015 Radloff ..... H04N 5/782 386/291
9,037,169 B2 * 5/2015 Cabos ..... H04B 7/18502 455/466
2002/0039072 A1 4/2002 Gremmert et al.
2002/0184060 A1 * 12/2002 Schmitz ..... G06Q 10/02 705/6

(Continued)

OTHER PUBLICATIONS

Results of Fast and Focused search 492903 for U.S. Appl. No. 13/911,398. Search conducted Aug. 14, 2015 by Mark Hutcherson, 2400 Electronic Information Center (Randolph 4B28).*

*Primary Examiner* — Jimmy H Tran
(74) *Attorney, Agent, or Firm* — Ostrager Chong Flaherty & Broitman P.C.

(57) ABSTRACT

A computer-based communications management system for managing multiple requests made by different users, in abstract or generalized formats, for data to be provided by various systems of interest. This computerized system is programmed to perform operations which ensure that requests from different users do not interfere with each other and that all information requested from the systems of interest is retrieved without missing or additional (i.e., not requested) information. Additionally, the system accommodates the functional differences between various systems of interest, and also uses relevant related data from other systems of interest to achieve greater data usefulness.

20 Claims, 3 Drawing Sheets

(56) References Cited

U.S. PATENT DOCUMENTS

2003/0027560 A1* 2/2003 Jammal ..... H04B 7/18506 455/417
2003/0074482 A1* 4/2003 Christensen ..... H04L 12/58 719/313
2003/0078719 A1* 4/2003 Zobell ..... G05D 1/0204 701/120
2003/0217363 A1* 11/2003 Brady, Jr. ..... H04L 29/06 725/76
2004/0078821 A1* 4/2004 Frisco ..... H04H 20/62 725/76
2005/0055228 A1* 3/2005 Boyer, Jr. ..... G06Q 10/02 705/28
2005/0137917 A1* 6/2005 Agapi ..... G06Q 10/025 705/6
2005/0216139 A1* 9/2005 Laughlin ..... G08G 5/0013 701/3
2005/0216317 A1* 9/2005 Medellin ..... G06Q 10/025 705/6
2005/0262250 A1* 11/2005 Batson ..... G06F 12/0831 709/230
2005/0278753 A1* 12/2005 Brady, Jr. ..... G06F 17/30861 725/76
2006/0106655 A1* 5/2006 Lettovsky ..... G06Q 10/02 705/6
2006/0271967 A1* 11/2006 So ..... H04B 1/205 725/76
2007/0156469 A1* 7/2007 Bird ..... G06Q 10/02 705/5
2007/0240203 A1* 10/2007 Beck ..... G06F 19/322 726/4
2008/0154448 A1* 6/2008 Mead ..... G06Q 50/00 701/14
2008/0240062 A1* 10/2008 Lynch ..... H04B 7/18508 370/338
2008/0288164 A1 11/2008 Lewis et al.
2009/0012663 A1 1/2009 Mead et al.
2009/0100476 A1* 4/2009 Frisco ..... H04B 7/18508 725/68
2009/0157288 A1 6/2009 Bailey et al.
2009/0171782 A1* 7/2009 Stolbun ..... G06Q 10/02 705/14.53
2009/0276250 A1* 11/2009 King ..... G06Q 10/02 705/5
2009/0281844 A1* 11/2009 Probst ..... G06Q 10/02 705/5
2009/0282469 A1* 11/2009 Lynch ..... H04W 84/005 726/11
2010/0049382 A1 2/2010 Akalinli et al.
2010/0064327 A1* 3/2010 Lynch ..... B64D 11/0015 725/76
2010/0114633 A1* 5/2010 Sislak ..... G06Q 10/047 701/120
2010/0152932 A1* 6/2010 Das ..... G01C 23/00 701/14
2010/0191624 A1* 7/2010 Sharir ..... G06F 17/3089 705/30
2010/0191754 A1* 7/2010 Baker ..... G06Q 10/109 707/758
2010/0241345 A1 9/2010 Cornell et al.
2010/0332122 A1* 12/2010 Weichbrod ..... G01C 23/005 701/533
2011/0029650 A1* 2/2011 Shah ..... G06F 11/0748 709/223
2011/0050458 A1 3/2011 Bailey et al.
2011/0054718 A1 3/2011 Bailey
2011/0160940 A1* 6/2011 Schapiro ..... G08G 5/0013 701/14
2012/0078577 A1* 3/2012 Allen ..... G06F 11/0781 702/183
2013/0073120 A1* 3/2013 Bailey ..... G08G 5/0013 701/2
2013/0085672 A1* 4/2013 Stewart ..... G08G 5/003 701/528
2013/0132419 A1* 5/2013 Befort ..... G06Q 10/06 707/769
2013/0204484 A1* 8/2013 Ricci ..... G06F 17/00 701/29.4
2013/0211701 A1* 8/2013 Baker ..... G06Q 30/02 701/120
2013/0227030 A1* 8/2013 Eidelson ..... H04L 67/1095 709/206
2013/0304758 A1* 11/2013 Gruber ..... G06F 17/30976 707/769
2014/0164713 A1* 6/2014 Sim ..... G06F 12/0888 711/138
2014/0173755 A1* 6/2014 Wahl ..... G06F 21/6218 726/28
2014/0344374 A1* 11/2014 Attar ..... G06Q 50/14 709/206
2015/0006548 A1* 1/2015 Huang ..... G06F 17/30345 707/749

* cited by examiner

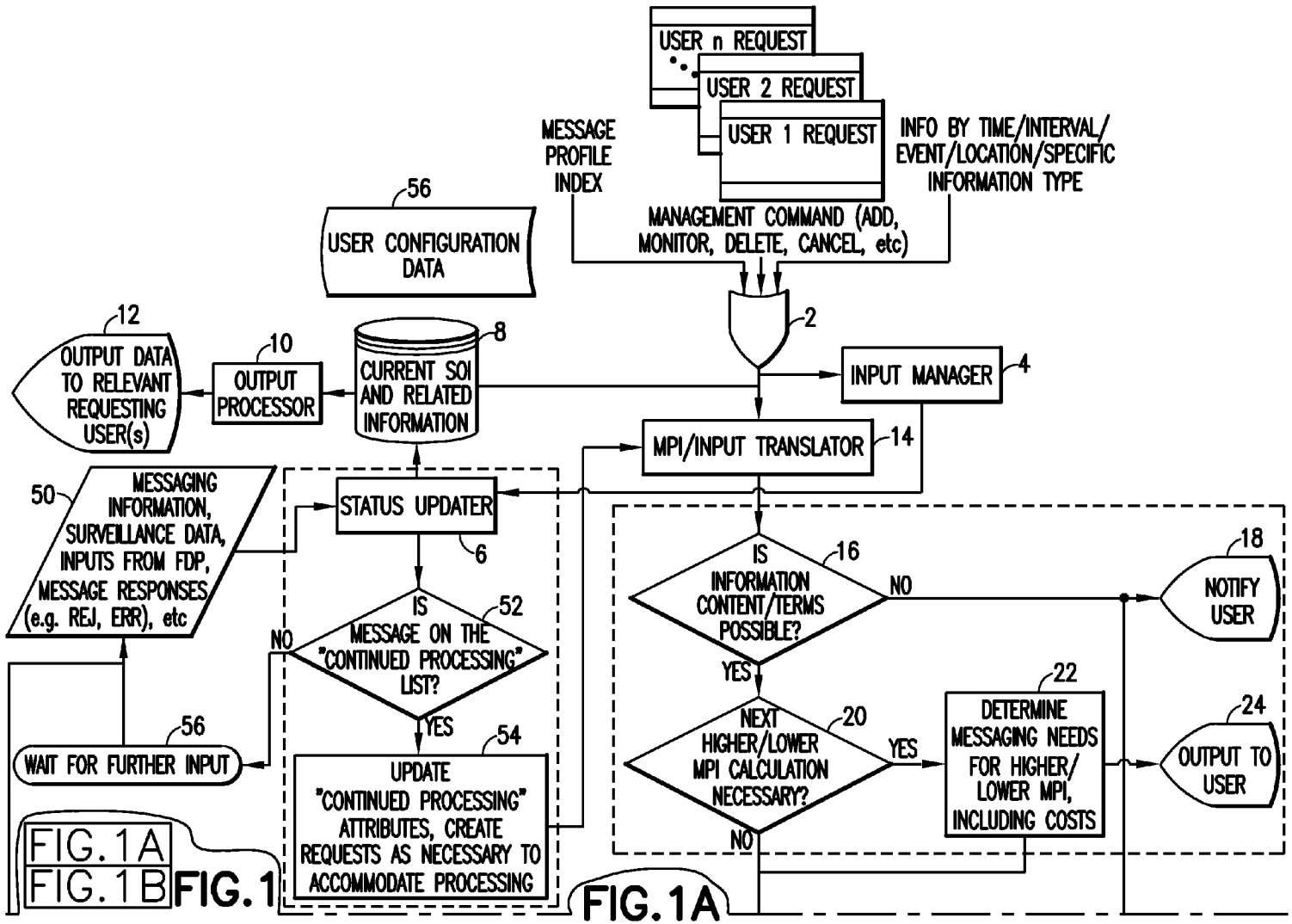
USER n REQUEST
USER 2 REQUEST
USER 1 REQUEST
INFO BY TIME/INTERVAL/ EVENT/LOCATION/SPECIFIC INFORMATION TYPE
MANAGEMENT COMMAND (ADD, MONITOR, DELETE, CANCEL, etc)
MESSAGE PROFILE INDEX
2
INPUT MANAGER
4
MPI/INPUT TRANSLATOR
14
IS INFORMATION CONTENT/TERMS POSSIBLE?
16
NO
YES
NOTIFY USER
18
NEXT HIGHER/LOWER MPI CALCULATION NECESSARY?
20
YES
NO
DETERMINE MESSAGING NEEDS FOR HIGHER/ LOWER MPI, INCLUDING COSTS
22
OUTPUT TO USER
24
USER CONFIGURATION DATA
56
CURRENT SOI AND RELATED INFORMATION
8
STATUS UPDATER
6
IS MESSAGE ON THE "CONTINUED PROCESSING" LIST?
52
YES
NO
UPDATE "CONTINUED PROCESSING" ATTRIBUTES, CREATE REQUESTS AS NECESSARY TO ACCOMMODATE PROCESSING
54
OUTPUT PROCESSOR
10
OUTPUT DATA TO RELEVANT REQUESTING USER(s)
12
MESSAGING INFORMATION, SURVELLANCE DATA, INPUTS FROM FDP, MESSAGE RESPONSES (e.g. REJ, ERR), etc
50
WAIT FOR FURTHER INPUT
56
FIG. 1A
FIG. 1B
FIG. 1

MULTI-USER DISPARATE SYSTEM COMMUNICATIONS MANAGER

BACKGROUND

This disclosure generally relates to methods for controlling the transmitting of data messages to and from systems (e.g., an aircraft) and disseminating that information to the appropriate user.

Various systems may request information from other systems of interest in order to obtain information that may be relevant to the requestor's needs. The information retrieved from systems of interest may involve specific state, environment or event information that is useful for particular applications of the requesting system. Multiple systems may have an interest in different information from the same systems of interest. The transmission criteria for this information may overlap depending on the specific information requested. This criteria may include periodic reporting, event reporting, or reports that are done upon demand from requestors. For example, aircraft transmit messages on a periodic basis, in response to specific events on board the aircraft and on-demand from the flight crew or ground system. Additional messages are also available that provide information relevant to aircraft (e.g., surveillance data). The ordering, delivery method, content and timing of the messages define a messaging profile. There are many different sets of messages that may support particular services, with each service potentially having different messaging needs. In order to fulfill a real-time efficiency analysis, a specific messaging profile is required.

U.S. patent application Ser. No. 13/424,661 (the disclosure of which is incorporated by reference herein in its entirety) discloses means for enabling real-time efficiency monitoring and delta efficiency calculations between various user- or system-selected phases of flight by determining an efficiency measuring-promoting messaging profile index (MPI) that is translated into a messaging profile. That messaging profile is then used to obtain necessary flight and other information from one or more systems of interest (SOI), such as aircraft. Basically a higher-efficiency MPI translates to more messaging required between an aircraft and the ground system, ground system to ground system or between an aircraft and other aircraft.

There are many cases, however, where users are not aware of other messaging that may exist with a particular system of interest, and requests from some users may cause information that another user is dependent on to stop being reported, or may result in additional/different information being returned that is in a format, frequency or type not expected by the user requesting the information.

There is a need for systems and methods that solve the problem of how multiple users (applications, systems, etc.) can request data from the same system of interest (e.g., an aircraft), while ensuring that one user's data request does not impact other users' data requests.

SUMMARY

The subject matter of this disclosure relates to a computer-based communications management system for managing multiple requests made by different users, in abstract or generalized formats, for data to be provided by various systems of interest. This computerized system is programmed to perform operations which ensure that requests from different users do not interfere with each other and that all information requested from the system of interest is retrieved without missing or additional (i.e., not requested) information. Additionally, the system accommodates the functional differences between various systems of interest, and also uses relevant related data from other systems of interest to achieve greater data usefulness.

One aspect of the subject matter disclosed in detail below is a communications management system comprising a computer system programmed to execute the following operations: (a) store information representing data and the status of various systems of interest in computer memory; (b) receive user requests from one or more users seeking information regarding a system of interest; (c) determine whether a user request from a first user seeks information that is stored in the computer memory or information that is not stored in the computer memory; (d) if a determination is made in operation (c) that the user request from the first user seeks information that is not stored in the computer memory, then create a messaging profile for messaging to obtain information from at least the system of interest; (e) determine whether the messaging profile conflicts with currently scheduled messaging requesting information regarding the system of interest or not; and (f) if a determination is made in operation (e) that the messaging profile is in conflict with currently scheduled messaging regarding the system of interest, then execute a conflict resolution process. The conflict resolution process is capable of determining whether the conflict can be resolved without affecting other messaging or not. If the conflict resolution process determines that the conflict cannot be resolved without impacting other messaging, the conflict resolution process is further capable of formulating a replan comprising a revised messaging profile, the replan being formulated to meet the messaging needs and requirements for users and the system of interest. In accordance with one implementation, the replan formulation comprises merging conflicting requests for information, the results of the merger being included in the revised messaging profile, or substituting one conflicting request for information for another conflicting request for information, the results of the substitution being included in the revised messaging profile.

In accordance with further aspects, the computer system is further programmed to execute the following operations: (g) construct one or more messages requesting information in accordance with the revised messaging profile; (h) send the one or more messages requesting information to the system of interest and any more messages requesting information to one or more other systems of interest; (i) receive information responsive to the sent messages; (j) filter out from the received information any system information not relevant to individual user requests; and (k) send the relevant information remaining after filtering to each requesting user.

Another aspect of the disclosed subject matter is a communications management system comprising a computer system programmed to execute the following operations: (a) store information representing the status of various systems of interest in computer memory; (b) receive user requests from one or more users seeking information regarding a system of interest; (c) determine whether a user request from a first user seeks information that is stored in the computer memory or information that is not stored in the computer memory; (d) if a determination is made in operation (c) that the user request from the first user seeks information that is not stored in the computer memory, then create a messaging profile for current and future messaging to obtain information from at least the system of interest; (e) construct one or more messages requesting information; (f) send the one or more messages requesting information to the system of interest and any more required messages requesting information to one or more other systems of interest; (g) establish or update rules for continued processing of the future messaging for one or more systems of interest; (h) construct one or more messages requesting information in accordance with the rules for continued processing as appropriate; and (i) send the one or more messages requesting information to the system of interest and any more messages requesting information to one or more other systems of interest.

A further aspect is a method, performed by a computer system, comprising: (a) storing information representing the status of various systems of interest in computer memory; (b) receiving user requests from one or more users seeking information regarding a system of interest; (c) determining whether a user request from a first user seeks information that is stored in the computer memory or information that is not stored in the computer memory; (d) creating a messaging profile for messaging to obtain information from at least said system of interest if it was determined that the user request from the first user seeks information that is not stored in the computer memory; (e) determining whether said messaging profile conflicts with currently scheduled messaging requesting information regarding said system of interest or not; and (f) executing a conflict resolution process if it was determined that said messaging profile is in conflict with currently scheduled messaging requesting information regarding said system of interest.

Other aspects are disclosed and claimed below.

BRIEF DESCRIPTION OF THE DRAWINGS

Various embodiments will be hereinafter described with reference to drawings for the purpose of illustrating the foregoing and other aspects of the invention.

FIG. 1 is a diagram showing the relationship of FIGS. 1A and 1B. FIGS. 1A and 1B are diagrams showing components of a communications system comprising a communications manager that manages communication between users (e.g., subscribers) and systems (e.g., aircraft).

DETAILED DESCRIPTION

The following description refers to various processes that are executed by one or more processors. These processes take the form of software running on one or more computers. It should be appreciated that the each disclosed process can be executed by a respective processor or all processes can be executed by one processor or any variation therebetween.

The communications manager disclosed in detail hereinafter is programmed to solve the problem of how multiple users (applications, systems, etc.) can request information from the same system of interest (e.g., an aircraft), while ensuring that its information request does not impact other users' information requests. The communications manager also comprises a process that enables users to request information in a simplified, generic format, so that they do not need to know the details of the system of interest they are requesting information from, only the type of information that is needed. The communications manager also ensures that the information it sends to the requesting users contains only the information that is relevant to each user; other, unrequested information that may cause unintended consequences to a user not expecting it is prohibited from being sent.

Figure 1B:
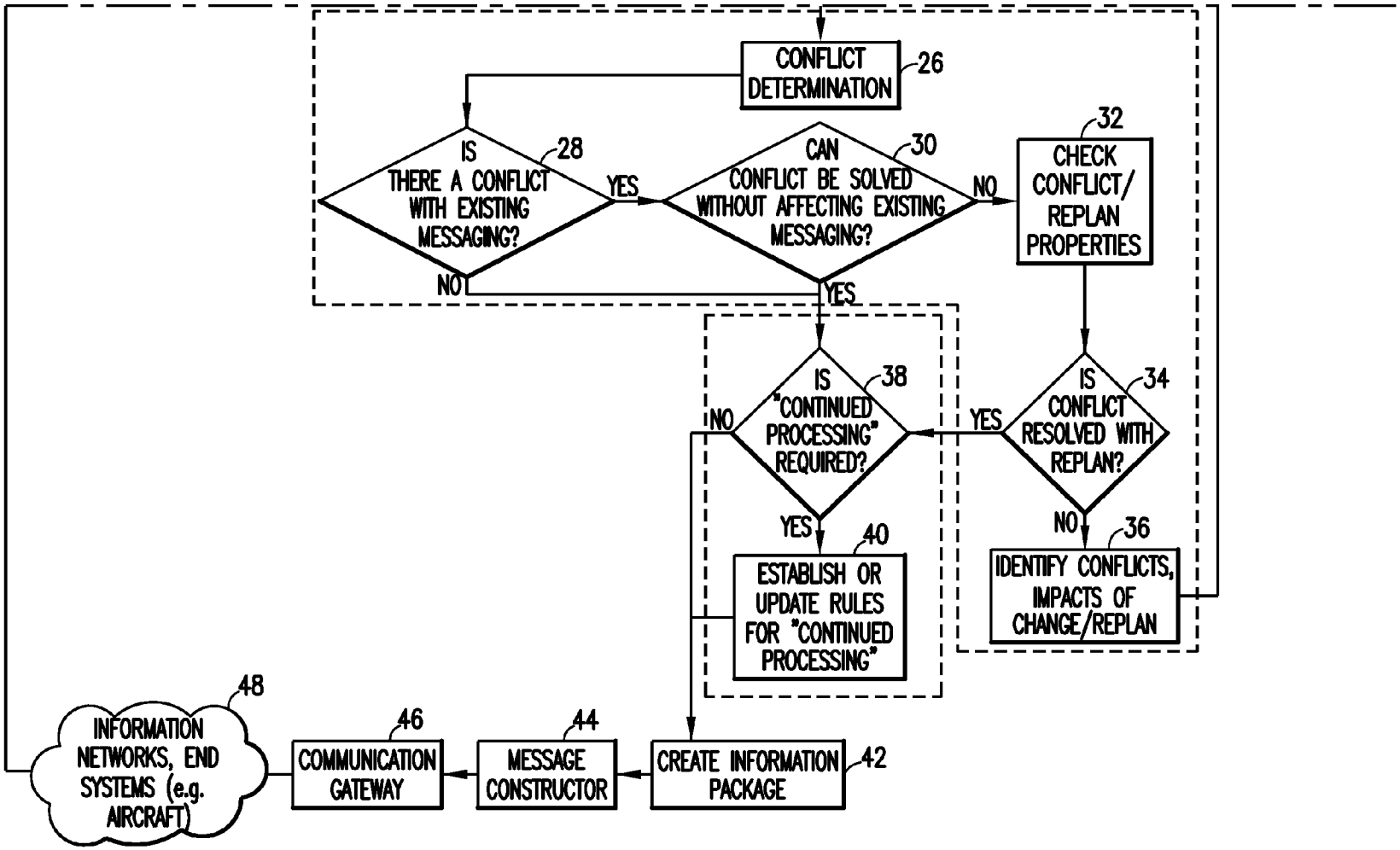

FIG. 1 (comprising FIGS. 1A and 1B) shows respective portions of a communications system comprising a computer system programmed to manage communications between users (e.g., subscribers) and systems (e.g., aircraft). That computer system will be referred to hereinafter as the "communications manager". As used herein, the term "computer system" means a system having at least one computer and/or at least one processor, and which may have multiple computers and/or processors that communicate with at least one other computer or processor in the group by means of a network (wired or wireless) or a bus. As used in the preceding sentence, the terms "computer" and "processor" both refer to devices having a processing unit (e.g., a central processing unit) and some form of memory (i.e., computer-readable medium) for storing a program which is readable by the processing unit.

At a high level, FIGS. 1A and 1B show a communications system comprising a communications manager in accordance with one embodiment. The communications manager comprises a computer system programmed to execute multiple processes that perform tasks in conjunction with one another. These tasks are shown in FIGS. 1A and 1B.

Referring to FIG. 1A, there are a number of configuration details of the communications manager (CM) that need to be decided and input prior to the start of CM processing. Some of the configuration data can also be changed dynamically at run-time to adapt to changing situations as they arise. User configuration data can be human input, retrieved from stored data, or dynamically determined by the system based on available data or other selection criteria. The user configuration data 56 stores configuration data in a way that it is accessible to all processes of the CM system. The stored configuration data relates to more than just the users; some configuration data relates to the systems of interest (SOI). The stored configuration data includes, but is not limited to, costing information for messaging, specific configuration data for the systems of interest that is necessary for format/capability interactions (e.g., aircraft model, component versions, and supported functionality details), SOI operator and operations configuration details (e.g., if the system of interest is an aircraft that belongs to a particular airline, this would include information on preferred airline operating methods, known limitations, scheduling information, etc.), user notification preferences (how different users of the CM prefer to be made aware of various alerts and information from the CM), lists of systems of interest, SOI time expiration constraints and information (i.e., when a system of interest stops being of interest), etc.

The communications manager further comprises a current SOI and related information database 8, which stores all information about the current states of all systems of interest. As new information about the systems of interest is received by the communications manager, the current SOI and related information database 8 will be updated by a status updater 6. Updates may include new messages/information that are received from the systems of interest. For example, if there is periodic and event messaging in place with a system of interest, then messages from that system of interest will be received unsolicited. These messages contain updated information concerning the latest status of that system of interest. The current SOI and related information database 8 might employ a software architecture that publishes updates to all processes that are subscribers (meaning that subscribers need not transmit requests for updates). The current SOI and related information database 8 includes a multitude of specific information related to the SOI. An example would be if the SOI is an aircraft, the specific information may comprise flight information. The flight information may include, but is not limited to, aircraft-specific information (e.g., type-specific performance characteristics and parameters, messaging capabilities, software capabilities, etc.), processed flight plan and trajectory information (such as those received from a flight plan processor system, trajectory predictor system, etc.), surveillance data (e.g., radar, ADS-B, ADS-C, etc.), airline preferences/adaptation data, aircraft-generated messages (including airline operational control (AOC), air traffic services (ATS), and other types) and optionally multiple levels of optimum flight trajectories for particular aircraft.

A user of the communications manager may input information into the communications manager in different ways via a message multiplexer 2. A messaging profile index (MPI), messaging details (e.g., information by time, time interval, event, location, or specific information type), or management commands (e.g., add, monitor, delete, cancel) are submitted by a user that desires communication with a system of interest external to the communications manager. Users of the communications manager have the option of using any one of these types of input methods to request information or manage the communications manager. Additionally, the input into the message multiplexer 2 may also be from another communications manager. This would allow communications managers to share information regarding data, and message profiles for SOIs. The inputs are multiplexed into the communications manager.

The communications manager further comprises an input manager 4 which processes each input. The input manager 4 passes the new user requests to the status updater 6, which then updates and saves the information in the current SOI and related information database 8. The input manager 4 also determines whether the status of a current system of interest should be updated or not. If an update is called for, the input manager 4 passes this information to the status updater 6. The input manager 4 also identifies any new systems of interest to be added or current systems of interest to be removed from the current SOI and related information database 8 and passes that information to the status updater 6. If there is a user or a system of interest that is completely new (i.e., has had no previous interactions with the communications manager), then these configuration details may also need to be added to the configuration data 56. Thus the input manager 4 assists in maintaining the integrity of the stored SOI and user data, and ensures that the status updater 6 is supplied with information needed to update the current SOI and related information database 8.

Management commands (e.g., add, monitor, delete, cancel) are also handled by the input manager 4. These commands are applicable to configuration data, current SOI information and user requests. If a current system of interest is to be changed, the input manager 4 passes on the information to the status updater 6, which then updates the current SOI and related information database 8. User configuration data may also be changed in this way or changed directly by other means. A user request may also be affected. For example, if there are pending transactions (i.e., the "continued processing" described below), these can be changed or canceled by the input manager 4 sending an instruction to the processor that runs the "continued processing" routines (e.g., process 40 seen in FIG. 1B and process 54 seen in FIG. 1A).

The communications manager further comprises an MPI/input translator 14, which also receives the user requests from the input multiplexer 2. The MPI/input translator 14 breaks down those inputs to see how each input would need to be realized in order to meet the requirements of the user. The term "break down" means that the input information is parsed and potentially split into different data segments (depending on the input information) in order to process the information. This includes information that may already exist for the SOI (e.g. information retrieval from Current SOI and Related Information, 8). Systems of interest to users may also be interacting with other external users. In this case, additional messages may be received regarding a particular system of interest that were not requested by the current user. These messages may be useful or in conflict so they need to be handled. As part of this process, the MPI/input translator 14 receives updates of SOI information from the current SOI and related information database 8 to check for messaging leverage. (The term "message leveraging" means that information from systems of interest or other sources can be used to provide additional input to assist in determining the state of the system of interest that is the subject of the user request being processed.) The updates may be derived from new information (see block 50 in FIG. 1A) received by the communications manager, with new information possibly taking the form of one or more of the following: responses to update requests previously sent by the communications manager; responses to prior requests from external users; updated position or trajectory information, etc.

The MPI/input translator 14 then determines, based on the user request and all available information (including user configuration data), the messaging profile, which identifies the types of messages needed within the constraints of the request and available information, as well as any parameters that the messages will take such as triggering events, desired contents to be returned, etc. Not all user requests will result in new messaging with the SOI. If, on the one hand, a user requests information which is already in the current SOI and related information database and the MPI/input translator 14 determines that the available information satisfies the requirements of the user request being processed, then no message requesting updated information will be constructed for that user request. If information is required to be given to a user, that information is packaged as the specific user expects it and subsequently output to the user by output processor 10. If, on the other hand, a user requests information that the MPI/input translator 14 determines is not already available or covered by messaging currently in place with the system of interest, then a normalized messaging profile will be created with the intention that one or more messages requesting the necessary information will be constructed (in accordance with the normalized messaging profile) and sent to relevant systems of interest.

A messaging profile is generally set by the ground system, and depending on the types of messages chosen, may require periodic queries, event-based messages or updates from the ground system to interrogate aircraft or other systems of interest. If the input is an MPI, the MPI/input translator 14 will manage the creation of the appropriate messaging profile corresponding to that MPI value. If a change in the value of the MPI is required, this will likely require some action by the communications manager to dynamically change the messaging of an aircraft or other system of interest.

The messaging profile index can be a major factor in dictating the messaging profiles, and allows a user to specify a desired level of SOI information. In the case of aircraft, changes in information provided may be due to changes to the aircraft's trajectory, be it from flight crew action, environmental effect, aircraft design or air traffic control intervention. The MPI can be thought of as a scale of accuracy, where more accuracy generally requires additional or different information. More accuracy commonly requires a greater level of messaging in order to provide the updated relevant information to meet the desired MPI. This also generally means an increase in cost.

The messaging profile can be applied to individual SOI or to more than one SOI in a group(s). These groups can be defined by potential influences and/or commonality in distance (e.g., from each other or from specific points), time, path (e.g., flight path including altitude), SOI type, and other factors. By grouping the SOIs, the user can, at little or no additional impact, receive more accurate information about or from other SOI in the group. The fact that some of the messaging may be shared between SOIs (e.g., downlinked meteorological information can apply to all of the aircraft in a group, where the SOIs are composed of aircraft) is also taken into consideration. In response to a user request for information regarding a particular system of interest, the MPI/input translator 14 checks the current SOI information for other systems of interest and any information available from other sources to determine if there is an opportunity to define a group that will allow the available information to be leveraged.

Referring to FIG. 1B, the normalized messaging profile output by the MPI/input translator 14 is intended for eventual use by a message constructor 44, which creates each message in the specified format. These messages will be in the proper format for the specific SOI, taking into account the SOI capabilities, equipage and software loads. In the case where an SOI is an aircraft, the messages may be a combination of AOC and ATS message types, and may require repetitive transmissions in order to receive the necessary data as dictated by the user request. Additionally, the message constructor 44 will handle any protocol necessary in order to subsequently handle the messaging (e.g., for a particular type of messaging contract that will periodically require uplinks with additional information). The messages requesting flight and other information from information networks and systems of interest 48, such as aircraft, are sent via a communications gateway 46. But before a message can be constructed, the updated messaging solution (as represented by the messaging profile output by the MPI/input translator 14) undergoes further processing, as described below.

Returning to FIG. 1A, after the MPI/input has been translated by the MPI/input translator 14, further processing takes place to determine whether it is possible for the requested information to be provided by the system of interest (step 16) or not. In some cases, there may be data requested that is not available or cannot be derived. For these cases, the requesting user and/or the system operator will be notified (step 18).

Another feature of the communications manager, when an MPI is being used, is to determine whether a next higher or next lower MPI should be calculated or not (step 20). This service may be used when the user is using the CM for real-time efficiency monitoring and delta efficiency calculations between various user- or system-selected phases of flight. A set of dynamic thresholds can be input into the communications manager that will give the next higher and lower messaging requirements for an MPI, taking into account key factors such as cost or performance limitations. This means that if a user selects an MPI value of 6 (on a scale of 1 to 10, 1 being lowest accuracy, 10 being highest), the communications manager can show that in order to realize an MPI value of 7, additional messaging is required at a particular cost and make that additional messaging at the additional cost available to the user. Likewise, an MPI value of 5 might result in less messaging or smaller message sizes with a corresponding savings. The user can then decide whether the additional messaging (and any changes resulting from it, e.g., increase in cost, increase in bandwidth utilization, etc.) is worth the additional information that would result or not. The user is also capable of manually initiating such a comparison, and can also specify checking between multiple level differences (e.g., between MPI values of 2 and 7).

If a determination is made in step 20 that the next higher or lower MPI should be calculated, the communications manager determines what the costs and information are to achieve the next higher or lower MPI (process 22). This information is then provided to the originating user and/or the system operator (step 24). This allows a user to have a better idea of the cost versus the capability that a different MPI value will provide.

Upon completion of the process comprising steps 20, 22 and 24, a conflict determination module 26 and its associated support logic, shown in FIG. 1B, determine whether any message conflicts exist (step 28 in FIG. 1B). More specifically, the communications manager examines existing message contracts or configurations that the system of interest is currently using to identify whether there is overlap/conflict between the desired messages and those already being used by other systems that are also communicating with the system of interest or not. These overlaps/conflicts may exist with other external systems that are communicating with the system of interest (for example, a trajectory predictor). If these systems communicate via the communications manager, then messaging conflicts will be addressed. For example, assume that the SOI is an aircraft, and that aircraft has a limited reporting capability, e.g., a request from one user to receive a status report from that aircraft two hours before arrival is pending, and the request currently being processed requests a status report from the same aircraft one hour before arrival. Under those circumstances, if the aircraft reports at two hours before arrival and can only send reports at five-hour intervals, then the aircraft will be unable to respond to the current user request for a status report one hour before arrival. The communications manager will attempt to resolve conflicts in a manner that optimizes the messaging that will be received by users, and will subsequently create a messaging profile to accommodate both users. This may be done by using inherent functionality in the SOI or by the communications manager performing additional processing in order to fulfill the need of the multiple users.

If there is no overlap/conflict, then the message solution can be implemented without affecting other users (i.e., go to step 38). If an overlap/conflict is detected, the communications manager then determines whether the overlap/conflict can be resolved without affecting existing messaging with other users (step 30) or not. If the overlap/conflict can be resolved without directly affecting other users' needs, the updated messaging solution is continued towards implementation (i.e., go to step 38).

If the overlap/conflict cannot be resolved without directly affecting other users' needs, then a determination is made (process 32 in FIG. 1B) which of the following options should be adopted: (1) merging of the two data sources; (2) modifying the current messaging to support all the necessary information exchange; or (3) notifying the user that no action has been taken and that the user needs to make the decision on how to proceed. The communications manager will attempt to resolve the overlap/conflict by fusing the information needs between the different messaging purposes, ensuring that no changes are made to functionality that other systems may need, e.g., when the system of interest is an aircraft, not changing the triggering parameters of an expected message, such as an ETA change threshold that has been set in an aircraft's AOC messaging configuration. This is called a "replan", as the messaging solution will need to be changed for multiple users. However, a replan should not affect the type of information or information that is returned for users that are not expecting a change to their messaging needs.

The conflict/replan properties (which are checked in process 32) dictate how the communications manager will attempt to resolve conflicts. Based on the conflict/replan properties, a preferred solution option is selected. In accordance with the options shown in FIG. 2 (described in detail below), the conflict may be resolvable by merging or overriding SOI information as part of a replan. The basis for the selection of a replan is CM user preference, which would be specified as part of the user configuration data.

However, the selected replan may not provide a "full" resolution, that is, the conflict may not be fully resolved by a replan. For example, if there are some replacements in messaging that are necessary, there may be some cases where some data fidelity is lost with the solution and cannot be accommodated by alternate messaging selections or with the "continued processing" described further below. In this case the conflict has not been fully resolved by the replan, so the current messaging situation, including conflict and impact information, may be indicated for additional action by the user.

After a replan has been selected, the communications manager determines whether the selected replan will resolve the conflict (step 34 in FIG. 1B) or not. If the conflict is fully resolved by the replan, then the updated messaging solution is continued towards implementation (i.e., go to step 38). If the conflict cannot be fully resolved by a replan, then the communications manager will discontinue implementation of the updated messaging solution for the user request in issue and instead will construct a notification (process 36 in FIG. 1B) to be sent to the user who submitted the request and/or the system operator (step 18 in FIG. 1A). In accordance with the process of step 2, the notice is constructed in a format that identifies the conflict and then sets forth the impacts of performing a change/replan (i.e., what information would be lost or changed for which user). For example, if resolving a message conflict with a particular solution means that some information will not get reported to one or more of the users of the data, these details would be listed in order to give the user more context of the issue. In response to the notice from the communications manager, the user may decide that this solution (reduced service for one user, full service for another, for example) is preferable to other alternatives (full service for one user, no service for another). So this solution, while not fully resolving the conflict, may resolve most of it and be subsequently selected by the user. The selected solution may be re-input into the message multiplexer 2 as a new user request or may be selected and processing continued as per step 38 in FIG. 1B.

Figure 2:
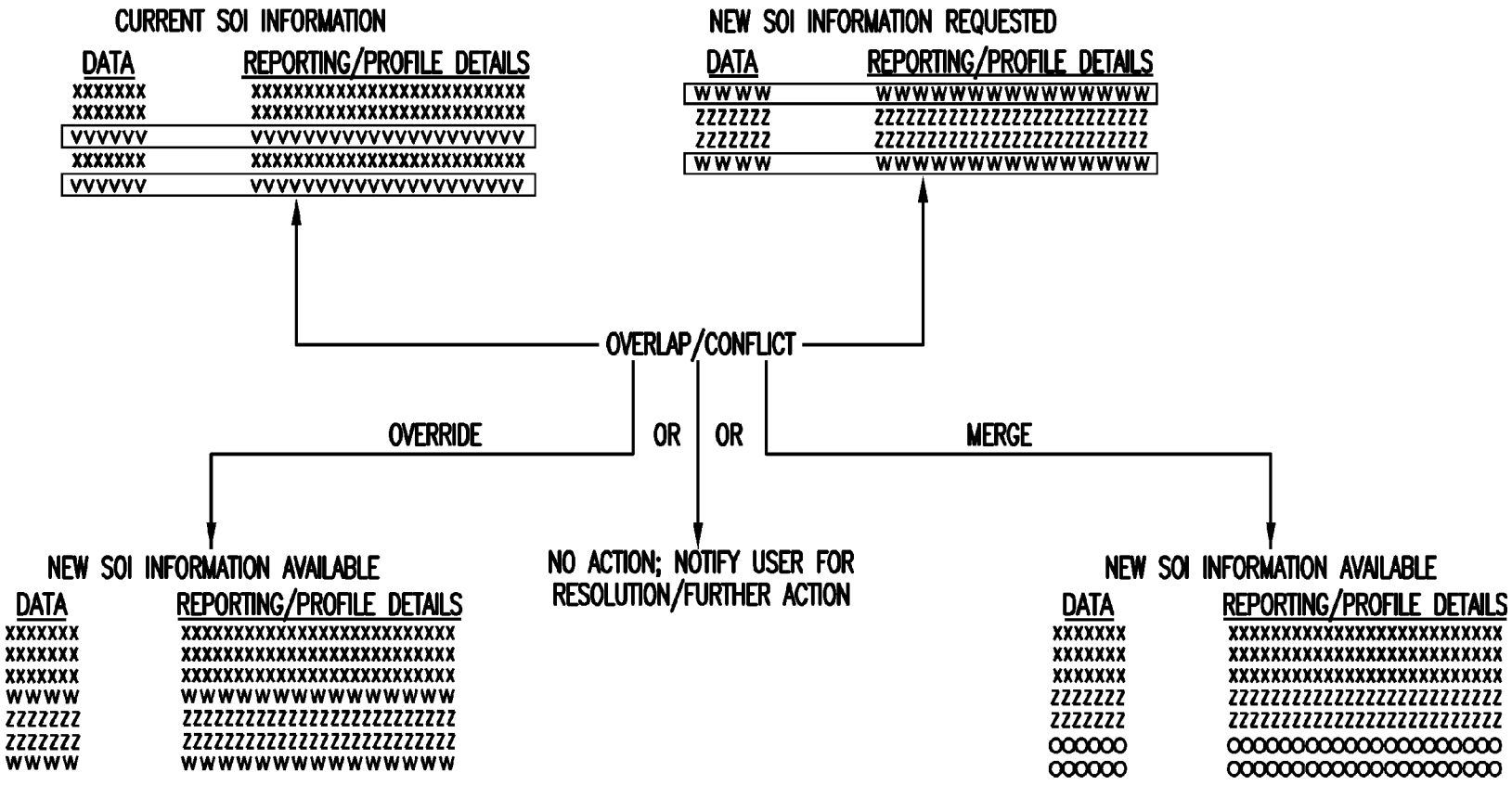
FIG. 2 is a flowchart showing a process performed by the communications manager in accordance with one embodiment whereby aircraft information requested in conflicting messaging profiles can be modified (e.g., replaced or merged) to resolve a conflict.

FIG. 2 shows a process performed by the communications manager in accordance with one embodiment whereby aircraft information requested in conflicting messaging profiles can be modified (e.g., replaced or merged) to resolve a conflict. Different message conflict resolution options in accordance with one embodiment are depicted. The choice will be made based on selection rules that are configuration data.

In FIG. 2, the current SOI messaging details for one user are shown as lines of lower-case letters "v" or "x", while a different user's request is shown as lines of lower-case letters "w" or "z". (It should be appreciated that the letters do not represent data content but rather strings of different letters represent data sets.) In this example, the "v" information is in conflict with the "w" information. More specifically, the rectangles surrounding the "v" lines in the Current SOI Information table and the rectangles surrounding the "w" lines in the New SOI information Requested table represent information that is in conflict, i.e., in order to get the information for both users, one user's desired information from the system of interest will be impacted in some way (e.g., different parameters will need to be used, different timing, etc.). The diagram then shows one of three options for responding to the conflict: (1) a merging of the two data sources; (2) taking no action to resolve the conflict between the two data sources and instead notifying users; or (3) modifying the current messaging to support all the necessary information exchange by overriding the components in conflict.

In the example shown in FIG. 2, the "override" option (shown in the lower left-hand corner of FIG. 2) involves the conglomeration of the "x" data from the Current SOI Information and the "w" and "z" data from the New SOI Information Requested information (i.e., the "v" data from the Current SOI Information is no longer used since it is also covered by the "w" information). The result is new messaging in which the conflict between the "v" and "w" information has been resolved by substituting new requested information (the "w" data) for old requested data (the "v" data").

In the example shown in FIG. 2, the "merge" option (shown in the lower right-hand corner of FIG. 2) involves the conglomeration of the "x" data from the Current SOI Information data, the "z" data from the New SOI Information Requested data, and "o" data formed by merging (i.e., fusing) together the "v" and "w" data. The result is new messaging in which the conflict between the "v" and "w" data has been resolved by data fusion, i.e., elements of "v" data and elements of "w" data have been selectively retained, and this new combined messaging is represented as "o" data.

Once conflicts are addressed, a determination is made whether "continued processing" should be initiated or not (step 38 in FIG. 1B). The term "continued processing" refers to additional steps performed by the communications manager to ensure that information requested by a requesting user is given to that user by the system of interest in accordance with the terms of the request. Optionally, this may be done due to a limitation in the system of interest, a limitation in the communication medium, or some other reason. For example, a system of interest that is an aircraft may only be able to report on a single event. If multiple event reports are desired, the communications manager will send a new event request after receiving one event report.

If in step 38 a determination is made to not initiate continued processing, then the communications manager will create an information package (see process 42 in FIG. 1B) in a format acceptable to message constructor 44.

If the message does require subsequent continued processing action, rules for continued processing are established or updated and the message is added to a "continued processing list". This is handled by process 40, which establishes a set of rules for systems of interest so that the communications manager can make the proper requests at the appropriate times in order to have the SOI provide the necessary information. Based on further external input or continuing internal communications manager events (e.g., a timer expiring, since the system of interest only has a limited time horizon), these rules are continually updated and managed by process 40.

Once any continued processing requirements have been determined, the information is then put into an information package (process 42) having a format that is acceptable to the message constructor 44. The message constructor 44 is a process that takes the input from the communications manager in a mutually understandable format and creates the actual correctly formatted message based on that information. The message constructor 44 then transmits the message out over the information networks and/or other media 48 via a communications gateway 46 to the correct system of interest. The communications gateway 46 handles the actual transmission of the message. This includes using the appropriate physical connection as well as ensuring that any higher level associations (e.g., channels, sockets, etc.) are used correctly. The communications gateway 46 can also serve as the front end for receiving information from systems of interest. The message constructor and communications gateway may be considered as part of the communications manager in one implementation, or in another implementation they may be considered external to the communications manager.

As messages 50 (see FIG. 1A) are received by the communications manager, they are processed by the status updater 6. The status updater 6 checks to see if there is new relevant data for one of the systems of interest for which a user has requested information. Any updates resulting from the message are given to the current SOI and related information database 8, which keeps all information about all systems of interest for the communications manager.

Incoming messages are also checked against a "continued processing" list (step 52) to determine whether their receipt indicates additional action is necessary by updating the "continued processing" rules or not. If the message does not require subsequent continued processing action, the communications manager simply waits for further inputs (step 56). If the message does require subsequent continued processing action, then process 54 tracks adherence to and updates the attributes of the "continued processing" rules. If new messaging needs to be created to support the continued processing, a new input (i.e., request) is generated by process 54. These updates/requests will be given to the MPI/input translator 14, which treats the new requests in the same way as if it had received a new input from an external user. In this way any updates resulting from continued processing are subjected to the same conflict checks to ensure that continued processing does not unexpectedly change a user's messaging.

The status updater 6 also monitors internal configuration parameters, so that it can update SOI information asynchronously (i.e., without external message input). This would be the case, e.g., for a timer expiry. The processing for this type of case is as described previously, i.e., it is the same as for when an external message is received.

After the current SOI information for a system of interest has been updated, the updating of the information may also trigger a new messaging input requirement. This would be the case when direct input into the configuration data of the communications manager results in a messaging update. For this case, the change will be evaluated and processed by the MPI/input translator 14 as described previously to ensure that no conflicts were introduced due to the change.

Once the current SOI information for a system of interest has been updated, that information and its associated user request(s) are sent from the current SOI and related information database 8 to the output processor 10. The output processor 10 determines whether the information that was updated needs to be given to one or more of the users that have requested information or not. If information is required to be given to the user, that information is packaged in accordance with the stored user configuration data associated with the user who requested the information. The output processor 10 is also responsible for ensuring that information irrelevant to a particular user is not given to that user, as irrelevant or unexpected data may adversely impact that user's operations. The output processor 10 filters out the information to be included in the report to the user. For example, assume that the following messaging conflict exists: (A) User A has requested a status report from a specific aircraft every 5 minutes; and (B) User B has requested a status report from the same aircraft every 10 minutes. If the communications manager has previously resolved this conflict by adopting 5-minute intervals and discarding 10-minute intervals, then output processor 10 will send reports at 5-minute intervals to User A, but will apply filtering to ensure User B only receives every other one of the reports received by User A in order to comply with its 10-minute requirement. Upon completion of output processing, the relevant information is output to the user in (step 12).

The above-described system provides a means by which multiple users are able to communicate with the same system(s) of interest without adversely impacting each other's requirements.

While a communications manager has been described with reference to various embodiments, it will be understood by those skilled in the art that various changes may be made and equivalents may be substituted for elements thereof without departing from the scope of the teachings herein. In addition, many modifications may be made to adapt the teachings herein to a particular situation without departing from the scope thereof. Therefore it is intended that the claims not be limited to the particular embodiments disclosed.

The method claims set forth hereinafter should not be construed to require that the steps recited therein be performed in alphabetical order or in the order in which they are recited. Nor should they be construed to exclude any portions of two or more steps being performed concurrently or alternatingly.

The invention claimed is:

1. A communications management system for managing requests made by users for flight information originated by aircraft, comprising a computer system which is not disposed on any one of the aircraft and which is programmed to execute the following operations:

(a) store flight information representing data and the status of various aircraft in a non-transitory tangible computer-readable medium;

(b) receive user requests from one or more users seeking flight information regarding an aircraft;

(c) determine whether a user request from a first user seeks flight information that is stored in the non-transitory tangible computer-readable medium or flight information that is not stored in the non-transitory tangible computer-readable medium;

(d) if a determination is made in operation (c) that the user request from the first user seeks flight information that is not stored in the non-transitory tangible computer-readable medium, then create a messaging profile for messaging to obtain flight information from at least said aircraft;

(e) determine whether said messaging profile conflicts with currently scheduled messaging requesting flight information regarding said aircraft or not; and (f) if a determination is made in operation (e) that said messaging profile is in conflict with currently scheduled messaging requesting flight information regarding said aircraft, then execute a conflict resolution process.

2. The system as recited in claim 1, wherein said conflict resolution process is capable of determining whether the conflict can be resolved without affecting other messaging or not.

3. The system as recited in claim 2, wherein if said conflict resolution process determines that the conflict cannot be resolved without impacting other messaging, said conflict resolution process is further capable of formulating a replan comprising a revised messaging profile, said replan being formulated to optimize impacts on messaging for users and the aircraft.

4. The system as recited in claim 3, wherein said formulating a replan comprises merging conflicting requests for flight information, the results of said merger being included in said revised messaging profile.

5. The system as recited in claim 3, wherein said formulating a replan comprises substituting one conflicting request for flight information for another conflicting request for flight information, the results of said substitution being included in said revised messaging profile.

6. The system as recited in claim 3, wherein said conflict resolution process is further capable of determining whether the replan should be approved by the requesting user or not, and if the replan should be approved by the requesting user, then constructing a conflict notice message containing flight information notifying the affected users of the conflict and the impact of the replan on the flight information sought by the requesting user.

7. The system as recited in claim 3, wherein said computer system is further programmed to execute the following operations:

(g) construct one or more messages requesting flight information in accordance with said revised messaging profile; and (h) send said one or more messages requesting flight information to said aircraft and any more messages requesting flight information to one or more other aircraft.

8. The system as recited in claim 7, wherein said computer system is further programmed to execute the following operations:

(i) receive flight information responsive to said sent messages;

(j) filter out from said received flight information any flight information not relevant to the user requests of the one or more users; and (k) send the relevant flight information remaining after filtering to the appropriate user.

9. The system as recited in claim 2, wherein said computer system is further programmed to execute the following operations provided that said conflict resolution process has determined that the conflict can be resolved without impacting other messaging:

(g) construct one or more messages requesting flight information in accordance with said messaging profile; and (h) send said one or more messages requesting information to said aircraft and any more messages requesting flight information to one or more other aircraft.

10. A communications management system for managing requests made by users for flight information originated by aircraft, comprising a computer system which is not disposed on any one of the aircraft and which is programmed to execute the following operations:

(a) store flight information of various aircraft in a non-transitory tangible computer-readable medium;

(b) receive user requests from one or more users seeking flight information regarding an aircraft;

(c) determine whether a user request from a user seeks flight information that is stored in the non-transitory tangible computer-readable medium or flight information that is not stored in the non-transitory tangible computer-readable medium;

(d) if a determination is made in operation (c) that a user request seeks flight information that is not stored in the non-transitory tangible computer-readable medium, then create a messaging profile to update the current messaging and future messaging to obtain flight information from at least said aircraft;

(e) construct one or more messages that will be used as the current messaging requesting flight information;

(f) send said one or more messages requesting flight information to said aircraft and any more messages requesting flight information to one or more other aircraft in order to establish the current messaging;

(g) establish or update rules for continued processing of said future messaging for one or more aircraft;

(h) construct one or more future messages requesting flight information in accordance with said rules for continued processing as appropriate; and (i) send said one or more future messages requesting flight information to said aircraft and any more future messages requesting flight information to one or more other aircraft.

11. The system as recited in claim 10, wherein said computer system is further programmed to execute the following operations:

(j) determine whether said messaging profile conflicts with currently scheduled messaging requesting flight information regarding said aircraft or not; and (k) if a determination is made in operation (j) that said messaging profile is in conflict with currently scheduled messaging regarding said aircraft, then formulate a replan comprising a revised messaging profile, said replan being formulated to optimize impacts on messaging for users and said aircraft.

12. A method for managing requests made by users for flight information originated by aircraft, comprising:

(a) storing flight information representing data and the status of various aircraft in a non-transitory tangible computer-readable medium;

(b) receiving user requests from one or more users seeking flight information regarding an aircraft;

(c) determining whether a user request from a user seeks flight information that is stored in the non-transitory tangible computer-readable medium or flight information that is not stored in the non-transitory tangible computer-readable medium;

(d) creating a messaging profile for messaging to obtain flight information from at least said aircraft if it was determined that the user request from the user seeks flight information that is not stored in the non-transitory tangible computer-readable medium;

(e) determining whether said messaging profile conflicts with currently scheduled messaging requesting flight information regarding said aircraft or not; and (f) executing a conflict resolution process if it was determined that said messaging profile is in conflict with currently scheduled messaging requesting flight information regarding said aircraft.

13. The method as recited in claim 12, wherein said conflict resolution process comprises determining whether the conflict can be resolved without affecting other messaging or not.

14. The method as recited in claim 13, wherein if said conflict resolution process determines that the conflict cannot be resolved without impacting other messaging, said conflict resolution process further comprises formulating a replan comprising a revised messaging profile, said replan being formulated to optimize impacts on messaging for users and said aircraft.

15. The method as recited in claim 14, wherein said formulating a replan comprises merging conflicting requests for flight information, the results of said merger being included in said revised messaging profile.

16. The method as recited in claim 14, wherein said formulating a replan comprises substituting one conflicting request for flight information for another conflicting request for flight information, the results of said substitution being included in said revised messaging profile.

17. The method as recited in claim 14, wherein said conflict resolution process further comprises determining whether the replan should be approved by the requesting user or not, and if the replan should be approved by the requesting user, then constructing a conflict notice message containing information notifying the affected users of the conflict and the impact of the replan on flight information sought by the requesting user.

18. The method as recited in claim 14, further comprising:

(g) constructing one or more messages requesting flight information in accordance with said revised messaging profile; and (h) sending said one or more messages requesting flight information to said aircraft and any more messages requesting flight information to one or more other aircraft.

19. The method as recited in claim 18, further comprising:

(i) receiving flight information responsive to said sent messages;

(j) filtering out from said received flight information any flight information not relevant to the user requests; and (k) sending the relevant flight information remaining after filtering to the appropriate user.

20. The method as recited in claim 13, further comprising:

(g) constructing one or more messages requesting flight information in accordance with said messaging profile; and (h) sending said one or more messages requesting flight information to said aircraft and any more messages requesting flight information to one or more other aircraft.

* * * * *